US006934482B2

(12) United States Patent
Iwai

(10) Patent No.: US 6,934,482 B2
(45) **Date of Patent: *Aug. 23, 2005**

(54) IMAGE FORMATION METHOD FOR AMPLIFYING DIFFERENCES IN POTENTIAL FOR IMAGE AND NON-IMAGE SECTIONS OF PHOTO SENSOR

(75) Inventor: Sadayuki Iwai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/825,132

(22) Filed: Apr. 16, 2004

(65) Prior Publication Data

US 2004/0264990 A1 Dec. 30, 2004

Related U.S. Application Data

(63) Continuation of application No. 10/136,279, filed on May 2, 2002, now Pat. No. 6,792,222.

(30) Foreign Application Priority Data

May 8, 2001 (JP) ..... 2001-137153

(51) Int. Cl.[7] ..... G03G 15/16
(52) U.S. Cl. ..... 399/66
(58) Field of Search ..... 399/66, 302, 308, 399/296, 298

(56) References Cited

U.S. PATENT DOCUMENTS 3,784,300 A 1/1974 Hudson et al.
4,348,098 A 9/1982 Koizumi
5,708,938 A * 1/1998 Takeuchi et al.
5,907,740 A 5/1999 Nozawa
5,923,930 A * 7/1999 Tsukamoto et al.
5,987,281 A * 11/1999 Kurotori et al.
5,987,282 A * 11/1999 Tsukamoto et al.
6,070,025 A 5/2000 Jeong
6,115,576 A * 9/2000 Nakano et al. ..... 399/302
6,148,169 A * 11/2000 Tsukamoto
6,226,469 B1 5/2001 Suzuki et al.
6,324,374 B1 * 11/2001 Sasamoto et al. ..... 399/302
6,347,212 B1 * 2/2002 Kosugi et al.
6,356,731 B1 3/2002 Shinjo
6,445,890 B2 9/2002 Ishii
6,792,222 B2 * 9/2004 Iwai ..... 399/66

FOREIGN PATENT DOCUMENTS

| | | |
|---|---|---|
| JP | 60-107060 | 6/1985 |
| JP | 8-160784 | 6/1996 |
| JP | 2000-75690 | 3/2000 |
| JP | 2000-305437 | 11/2000 |
| JP | 2002-91127 | 3/2002 |

* cited by examiner

*Primary Examiner*—Susan Lee
(74) *Attorney, Agent, or Firm*—Oblon, Spivak, McClelland, Maier & Neustadt, P.C.

(57) ABSTRACT

A potential difference between a surface potential of a photo sensor and a surface potential of an intermediate transfer belt is set such that a discharging occurs at an image section and no discharging occurs at a non-image section. Once a discharging has occurred at the non-image section on the photo sensor, the potential of the non-image section of the photo sensor is attenuated. Further, the polarity of the toner that slightly remains on the photo sensor at a developing time is inverted by the discharging.

10 Claims, 7 Drawing Sheets

IMAGE FORMATION METHOD FOR AMPLIFYING DIFFERENCES IN POTENTIAL FOR IMAGE AND NON-IMAGE SECTIONS OF PHOTO SENSOR

This is a continuation of U.S. application Ser. No. 10/136,279, filed on May 2, 2002 U.S. Pat. No. 6,792,222, which is based on and claims priority to foreign application Serial No. JP2001-137153, filed on May 8, 2001. Both applications are herein incorporated by reference in their entirety.

FIELD OF THE INVENTION

The present invention relates to an electrostatic transfer type image formation method for developing an electrostatic latent image on an image holder into a toner image by using a charged toner, and transferring this toner image onto an image-receiving unit.

BACKGROUND OF THE INVENTION

In one type of an image formation apparatus, first, a latent image formation unit forms an electrostatic latent image corresponding to a draft image on an image section of the photo sensor as an image holder. Then, the developing unit develops the electrostatic latent image formed on the image section of the photo sensor. Consequently, a toner image is prepared using a charged toner on the image section of the photo sensor. A transfer unit transfers the toner image formed on the image section of the photo sensor onto a transfer material or an intermediate transfer unit like paper or an OHP sheet as the unit that receives the image.

In the intermediate-transfer type image formation apparatus that uses an intermediate transfer unit as the image-receiving unit, it is possible to form a color image as is known well. In forming a color image in this intermediate transfer type image formation apparatus, first, the latent image formation unit sequentially forms electrostatic latent images, that are a draft image resolved into four colors, onto a photo sensor as an image holder. Next, the developing unit sequentially develops the electrostatic latent images of the four colors formed on the photo sensor, thereby to sequentially form color toner images of four-color charged toners of yellow, magenta, cyan, and black, on the photo sensor. An intermediate transfer process is carried out four times to transfer the toner images of the four colors formed on the photo sensor onto the intermediate transfer unit, thereby to sequentially superimpose the four-color toner images on the intermediate transfer unit to complete a primary transfer. Thereafter, the four full-color toner images obtained by the primary transfer based on the superimposition on the intermediate transfer unit are collectively transferred onto a transfer material like paper or an OHP sheet to complete a secondary transfer. As a result, a full-color image is formed on the transfer material. Various proposals have been made for the intermediate transfer unit. These include the units that use a resin belt having a sufficient lubricating surface like polyimide, PVDF, and ETFE, and a rubber material like urethane, NBR, and CR.

In another type of an image formation apparatus, transfer material wound around a transfer drum rotates in contact and in synchronism with the photo sensor. Based on this, toner images of various colors formed on the photo sensor are subsequentially transferred onto the image-receiving material wound around the transfer drum. According to this transfer drum type image formation apparatus, the transfer material used for this image formation apparatus is limited to the one that can be wound around the transfer drum. Therefore, there is a limitation to the use of the transfer material, as compared with the transfer material that is used in the intermediate transfer type image formation apparatus. Further, the transfer pressure applied at the time of transferring the image changes depending on the thickness of the transfer material. Therefore, this has a disadvantage in that color registration becomes unstable.

In the above image formation apparatuses, a reduction in sizes of these apparatuses and an increase in the image formation speed have been demanded in recent years.

However, reducing sizes and increasing the image formation speed of the apparatuses in order to satisfy these requirements has had the following difficulty. It is not possible to sufficiently develop an electrostatic latent image that is formed on the image section of the photo sensor, according to the general developing system, as described later. Further, when the rate of adhesion of the charged toner to the electrostatic latent image (the developing efficiency) is increased to compensate for the shortage in the development of the electrostatic latent image, the quantity of toner adhered to a non-image section (the texture section, or a section where there is no image) increases. The toner must not adhere to this section in principle. Consequently, what is called a "texture stain" phenomenon has occurred easily on the transfer image.

In order to sufficiently develop the image section of the electrostatic latent image formed on the photo sensor with the charged toner, it is usually necessary to form a development nip in the developing section between the photo sensor and the development roller, for example. This development nip has sizes that enable the securing of a developing time around 50 mm/sec to 100 mm/sec. Therefore, when the sizes of the apparatus are simply reduced or the image formation speed is increased, the sizes of the photo sensor and the development roller are reduced, and it becomes impossible to form a development nip having sufficient sizes. Further, the rotation speeds of the photo sensor and the development roller are increased, which makes it impossible to secure a sufficient developing time.

Therefore, when the sizes of the apparatus are simply reduced or the image formation speed is simply increased in the image formation apparatus, it becomes impossible to secure a sufficient developing time, and the development efficiency of the electrostatic latent image is lowered at the developing time. In order to compensate for a reduction in the development efficiency due to the reduction in sizes and increase in the speed of the image formation apparatus, there has been the following method. This method is to increase the quantity of toner adhesion to the electrostatic latent image formed on the photo sensor by increasing the development bias. According to this method, the efficiency of developing the image section of the photo sensor improves. However, the quantity of the toner adhered to the non-image section of the photo sensor increases, and this generates the "texture stain" on the transfer image.

Further, there is a method of using two development rollers which improve the development efficiency of the electrostatic latent image without changing the development bias. According to this method, however, it is necessary to prepare a new development roller, which leads to a cost increase. Further, installation space for this development roller is additionally required, which results in an increase in the sizes of the apparatus.

SUMMARY OF THE INVENTION

It is an object of the invention to provide an image formation method that can prevent a toner adhesion to a non-image section of an image holder and can form a satisfactory image with less stain on the texture.

The image formation method according to the present invention comprises forming an electrostatic latent image on the surface of an image holder, developing the electrostatic latent image by using a charged toner, and transferring a toner image from the image holder onto an image-receiving unit by applying a transfer bias to the image-receiving unit. An amount of the transfer bias is set such that potential difference between surface potentials of an image section and a non-image section of the image holder and a surface potential of the image-receiving unit generate a discharging at the image section and do not generate a discharging at the non-image section.

Other objects and features of this invention will become apparent from the following description with reference to the accompanying drawings.

DETAILED DESCRIPTIONS

Embodiments of an application of the present invention to a color laser printer (hereinafter to be simply referred to as a "printer") will be explained below.

Figure 1:
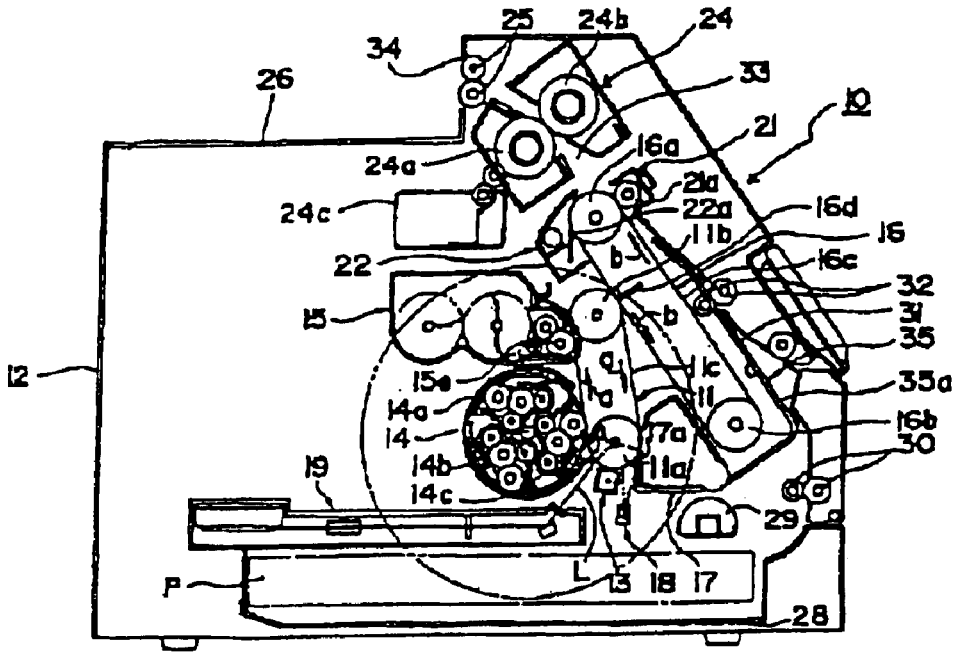
FIG. 1 is a schematic structure diagram of a dry-type laser printer according to an embodiment of the present invention.

FIG. 1 shows a total schematic structure of the printer. In FIG. 1, a printer main body 10 has a photo sensor 11 at a slightly front side of the center (at a right side in the drawing) within an exterior case 12. The photo sensor 11 is structured to have an endless photo sensor belt 11*c* applied to between a driving motor 11*a* and a subordinate roller 11*b*.

Around the photo sensor 11, there are disposed a multi-color developing unit 14, a black-color developing unit 15, an intermediate transfer unit 16, a photo sensor cleaning unit 17, and a charge removing unit 18. These are disposed in this order, with a charging unit 13 as a starting point, at the upstream of the photo sensor belt 11*c* that rotates in the direction of an arrow mark a. A laser writing unit 19 is disposed below the multi-color developing unit 14.

Figure 2:
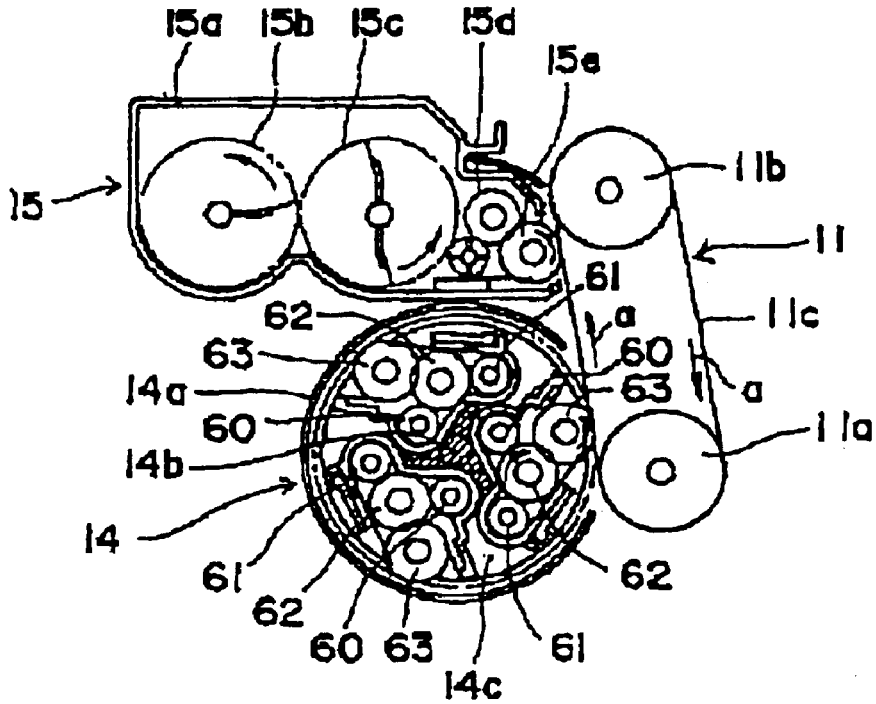
FIG. 2 is an enlarged diagram which shows a structure of a developing section of the laser printer.

In the multi-color developing unit 14, there is provided a supporting frame 14*c* that is rotatably supported by a center axis 14*b* within a cylindrical case 14*a*, as shown in FIG. 2. This supporting frame 14*c* is fitted with a developing unit that accommodates a yellow developing agent, a developing unit that accommodates a magenta developing agent, and a developing unit that accommodates a cyan developing agent, respectively. Referring to FIG. 2, when the supporting frame 14*c* is rotated around the center axis 14*b*, developing rollers 63 of these developing units can be sequentially brought into contact with the photo sensor belt 11*c*.

On the other hand, in the black-color developing unit 15, there are disposed agitators 15*b* and 15*c*, a supply roller 15*d*, and a development roller 15*e*, within a development case 15*a*, as shown in FIG. 2. The development case 15*a* of this black-color developing unit 15 is brought into contact with an eccentric cam on the left side not shown with a spring. When the black-color developing unit 15 is used, the development case 15*a* moves to a right direction in the drawing based on the rotation of the eccentric cam, and the development roller 15*e* is brought into contact with the photo sensor belt 11*c*.

The intermediate transfer unit 16 is structured to have an endless intermediate transfer belt 16*c* applied to between a driving motor 16*a* and a subordinate roller 16*b*. A part of the intermediate transfer unit 16 is in contact with the photo sensor belt 11*c*. A photo sensor image transfer unit 16*d* as a primary transfer unit is provided inside the contact position of the intermediate transfer belt 16*c* that is in contact with the photo sensor belt 11*c*. A transfer roller 21*a* of a combined-image transfer unit 21 as a secondary transfer unit is pressed against the external periphery of the driving roller 16*a* from a right side in the drawing. A cleaning member 22*a* of an intermediate-transfer unit cleaning unit 22 is pressed against the external periphery of the driving roller 16*a* from a left side in the drawing.

The transfer roller 21*a* and the cleaning member 22*a* are structured to be suitably contacted to or separated from the intermediate transfer belt 16*c* by a contact and separating mechanism not shown. At the time of transferring a toner imager onto the intermediate transfer belt 16*c* as a primary transfer, the transfer roller 21*a* and the cleaning member 22*a* are separated from the intermediate transfer belt 16*c* respectively.

The photo sensor cleaning unit 17 has a cleaning member 17*a* disposed to be pressed against the external periphery of the driving roller 11*a* of the photo sensor 11. With this arrangement, a developing agent (mainly a remaining toner) that remains on the photo sensor belt 11*c* after the image transfer is removed by the cleaning member 17*a*, and is recovered and stored inside the photo sensor cleaning unit 17.

The laser writing unit 19 irradiates a laser beam L based on write information, thereby to write this information at an image writing position A provided on the external periphery of the driving roller 11*a*. Thus, the laser writing unit 19 forms an electrostatic latent image on the photo sensor belt 11*c*.

In the printer main body 10, a fixing unit 24 is provided above the black-color developing unit 15. A paper discharge roller 25 is provided at the left side of the fixing unit 24, and a discharged-paper stacking section 26 is provided on the printer main body 10 at the left side of the paper discharge roller 25. The fixing unit 24 has a fixing roller 24*a* that incorporates a heater, a pressing roller 24*b* that presses against the fixing roller 24*a*, and an oil supply mechanism 24*c* that coats coil onto the peripheral surface of the fixing roller 24*a*.

The printer main body 10 is also provided with other electric units and a ventilation fan not shown. Further, a paper supply cassette 28 that accommodates paper P is detachably mounted at the bottom of the printer main body 10.

An image formation operation of the printer having the above structure will be explained next.

When the printer is used to form an image, a paper supply roller 29 rotates and feeds the paper P from within the paper supply cassette 28 in FIG. 1. A conveyor roller 30 conveys the paper P through a paper supply path 31. The conveyance of the paper is once halted and waited in a state that the paper is bumped against the nip of a resist roller 32.

During this period, the photo sensor belt 11*c* rotates in a direction of an arrow mark a, and the intermediate transfer belt 16*c* rotates in a direction of an arrow mark b. First, along the rotation of the photo sensor belt 11*c*, the charging unit 13 uniformly charges the surface of the photo sensor belt 11*c*. Next, based on first-color write information, the laser writing unit 19 irradiates the laser beam L to form a first-color electrostatic latent image onto the photo sensor belt 11*c*.

At a position opposite to the multi-color developing unit 14, the first-color electrostatic latent image on the photo sensor belt 11*c* is developed with a first-color developing agent of a first developing unit. The first-color developing agent of a first developing unit has moved to a development position at which the first developing unit is in contact with the photo sensor belt 11*c*. A first-color toner image that has been visibly formed on the photo sensor belt 11*c* by the development is transferred onto the intermediate transfer belt 16*c* by the photo-sensor image transfer unit 16*d* as a primary transfer of the first-color toner image. After the primary transfer of this first-color toner image, the first-color developing agent that remains on the photo sensor belt 11*c* is removed by the cleaning member 17*a* of the photo sensor cleaning unit 17.

Thereafter, when a second-color image formation and a third-color image formation are carried out, the laser writing is carried out based on respective write information, in a similar manner to that of the first-color image formation. Respective electrostatic latent images are sequentially formed on the photo sensor belt 11*c*. Next, a second developing unit and a third developing unit move to respective development positions at which these developing units are in contact with the photo sensor belt 11*c*, thereby to sequentially form respective electrostatic latent images. A second toner image and a third toner image that have been sequentially visibly formed on the photo sensor belt 11*c* by the development are sequentially superimposed onto the first-color toner image on the intermediate transfer belt 16*c*, thereby performing a primary transfer. The second-color developing agent and the third-color developing agent that remain on the photo sensor belt 11*c* are sequentially removed by the cleaning member 17*a* of the photo sensor cleaning unit 17.

When the black-color developing agent is used, the laser writing is carried out based on this write information, in a similar manner to that of the above image formations. An electrostatic latent image of a black-color image is formed on the photo sensor belt 11*c*. Next, the development roller 15*e* of the black-color developing unit 15 is brought into contact with the photo sensor belt 11*c*, thereby to develop the electrostatic latent image. A black-color toner image that has been visibly formed on the photo sensor belt 11*c* by the development is transferred onto the intermediate transfer belt 16*c* by the photo-sensor image transfer unit 16*d* as a primary transfer of the black-color toner image. After the primary transfer of this black-color toner image, the developing agent that remains on the photo sensor belt 11*c* is removed by the cleaning member 17*a* of the photo sensor cleaning unit 17. The photo sensor belt 11*c* that has been cleaned by the photo sensor cleaning unit 17 has the charge remaining on the surface removed by the charge removing unit 18. Thus, the photo sensor cleaning unit 17 is ready for the next writing.

After the combined color image has been formed on the intermediate transfer belt 16*c* as described above, the transfer roller 21*a* of the combined-image transfer unit 21 and the cleaning member 22*a* of the intermediate-transfer unit cleaning unit 22 are brought into contact with the intermediate transfer belt 16*c*. The resist roller 32 is rotated at a predetermined timing, and the waited paper P is conveyed to a secondary transfer position formed by the nip between the transfer roller 21*a* and the intermediate transfer belt 16*c*. Consequently, the combined color image that has been transferred onto the intermediate transfer belt 16*c* as a primary transfer is transferred onto the image formation plane (the lower surface) of the paper P as a secondary transfer by the transfer roller 21*a*.

The paper P carrying the secondary transfer combined color image is conveyed to between the fixing roller 24*a* and the pressing roller 24*b* via a conveyance path 33. Heat and pressure are applied to the paper between these rollers. The paper P fixed with the secondary transfer image is discharged from the paper discharge opening 34 onto the discharged-paper stacking section 26 by the paper discharge roller 25. Discharged sheets of paper are sequentially stacked on this stacking section 26.

In the mean time, after the secondary transfer of the combined color image onto the paper P, the developing agents that remain on the intermediate transfer belt 16*c* are removed by the cleaning member 22*a* of the intermediate-transfer unit cleaning unit 22. The developing agents removed from the intermediate transfer belt 16*c* are conveyed to the recovery section of the photo sensor cleaning unit 17, with a developing agent recovering unit not shown.

About the surface potential of the photo sensor 11 will be explained next.

In general, the toner of each color is charged in minus. Therefore, the photo sensor 11 is charged in minus by the charging unit 13. The charged potential of the photo sensor 11 is usually adjusted to about −650 V immediately after the charging. Thereafter, the area corresponding to the image section of the photo sensor 11 is exposed with the laser beam L, and the surface potential of this image section is reduced to about −50V. In the developing process, the development is carried out based on the adhesion of the toner onto the image section of the photo sensor 11. However, at this developing time, a slight quantity of the toner is also adhered to the non-image section of the photo sensor 11 due to the adsorptive force according to the van der Waals force of the toner particles and the photo sensor surface. Therefore, the slight quantity of toner remains on the non-image section.

Thereafter, when the photo sensor 11 reaches the primary transfer position of the intermediate transfer belt 16*c*, the surface potential of the photo sensor 11 becomes about −450 V at the non-image section and about −30 V at the image section. In this instance, the voltage applied to the intermediate transfer belt 16*c* is about +700 V, and the surface potential at the primary transfer position of the intermediate transfer belt 16*c* is about +250 V.

Therefore, a potential difference between the surface potential of the photo sensor 11 and the surface potential of the intermediate transfer belt 16*c* is about 280 V at the image section and about 700 V at the non-image section.

In general, a voltage at which a discharging is started between two objects has been known as the Paschen's law. This is expressed by the following equation (1) under the condition of the atmosphere and in an air gap of at least 10 μm $$Vd=312+6.2d \tag{1}$$

where, Vd represents a potential difference (V) at which a discharging is started, and d represents a distance between two objects (μm).

Therefore, when the potential difference Vd between the two objects is smaller than the value of the equation 1, no discharging occurs between these objects. According to the printer of the present embodiment, the potential difference between the surface potential of the photo sensor 11 and the surface potential of the intermediate transfer belt 16*c* is about 280 V at the image section and about 700 V at the non-image section. Therefore, no discharging occurs at the image section, and discharging occurs at the non-image section. When a discharging has once occurred at the non-image section of the photo sensor 11, the potential of the non-image section of the photo sensor 11 is attenuated. Further, the polarity of the toner that slightly remains on the photo sensor 11 at the developing time is inverted by the discharging. Consequently, in the printer of the present embodiment, the toner that remains on the non-image section of the photo sensor 11 is not transferred onto the intermediate transfer belt. When the surface potentials at the image section and the non-image section of the photo sensor 11 and the surface potential of the intermediate transfer belt 16*c* of the intermediate transfer unit 16 are set according to the equation 1, the following becomes possible. Namely, as explained above, it is possible to obtain a suitable condition for not transferring the toner adhered on the non-image section of the photo sensor 11 onto the intermediate transfer belt 16*c* of the intermediate transfer unit 16.

As is clear from the above example, the above suitable condition is that a surface potential Vt1 of the intermediate transfer belt 16*c* of the intermediate transfer unit 16 satisfies the following two expressions, $$|Vi-Vt1|<Vd \tag{2}$$

$$|Vb-Vt1|>Vd \tag{3}$$

where, Vd represents a potential difference at which a discharging is started between two objects in the environment of using the printer, Vi represents a surface potential of the image section of the photo sensor, and Vb represents a surface potential of the non-image section of the photo sensor.

Figure 3A:
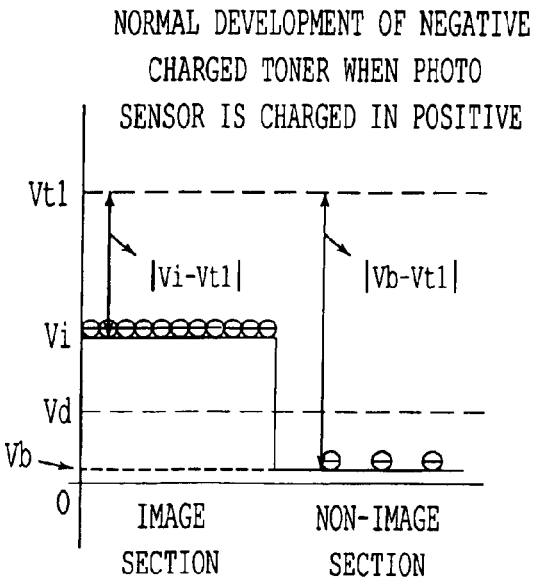
FIG. 3A is a diagram which shows a relationship between a surface potential of a photo sensor and a surface potential of an intermediate transfer belt when a normal development is carried out using a negative charged toner by positively charging the photo sensor of the laser printer.
Figure 3B:
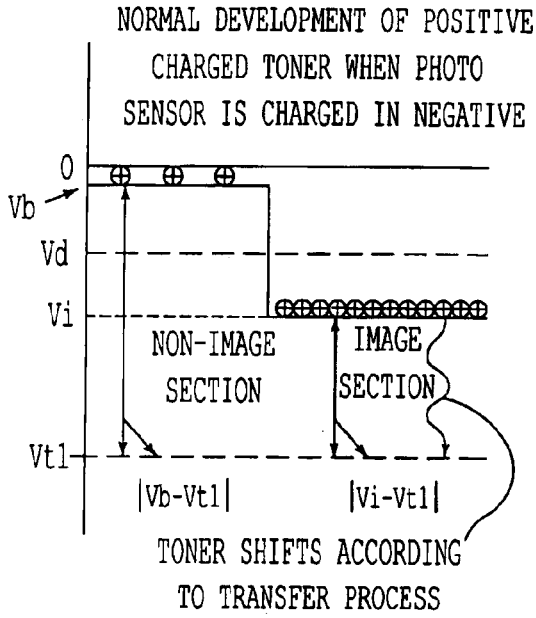
FIG. 3B is a diagram which shows a relationship between a surface potential of a photo sensor and a surface potential of an intermediate transfer belt when a normal development is carried out using a positive charged toner by negatively charging the photo sensor of the laser printer.
Figure 3C:
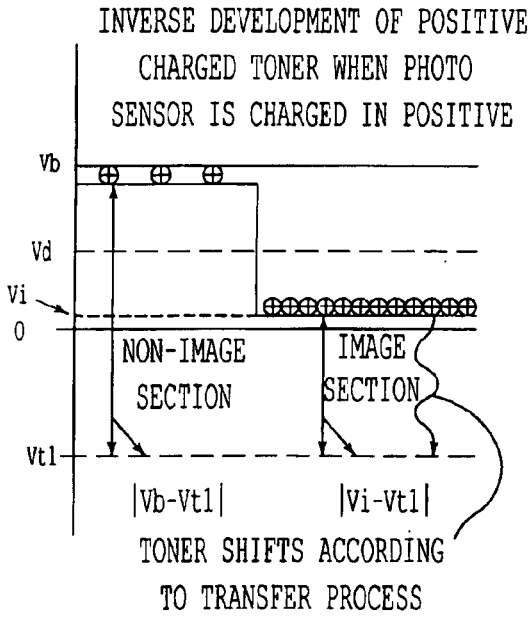
FIG. 3C is a diagram which shows a relationship between a surface potential of a photo sensor and a surface potential of an intermediate transfer belt when an inverse development is carried out using a positive charged toner by positively charging the photo sensor of the laser printer.
Figure 3D:
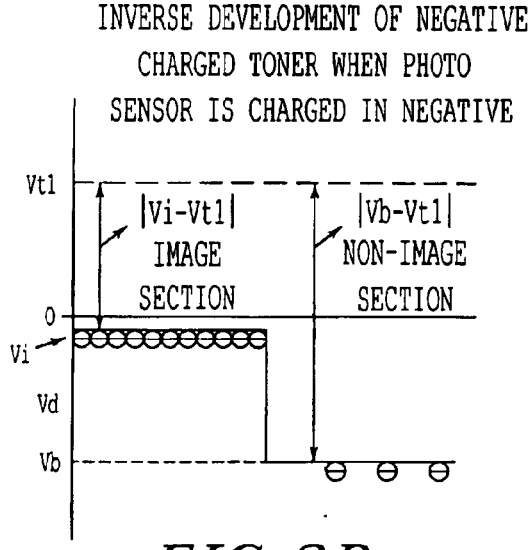
FIG. 3D is a diagram which shows a relationship between a surface potential of a photo sensor and a surface potential of an intermediate transfer belt when an inverse development is carried out using a negative charged toner by negatively charging the photo sensor of the laser printer.

FIG. 3A shows a relationship between a surface potential of the photo sensor 11 and a surface potential of the intermediate transfer belt 16*c* when a normal development is carried out using a negative charged toner by positively charging the photo sensor 11. FIG. 3B shows a relationship between a surface potential of the photo sensor 11 and a surface potential of the intermediate transfer belt 16*c* when a normal development is carried out using a positive charged toner by negatively charging the photo sensor 11. FIG. 3C shows a relationship between a surface potential of the photo sensor 11 and a surface potential of the intermediate transfer belt 16*c* when an inverse development is carried out using a positive charged toner by positively charging the photo sensor 11. FIG. 3D shows a relationship between the surface potential of the photo sensor 11 and a surface potential of the intermediate transfer belt 16*c* when an inverse development is carried out using a negative charged toner by negatively charging the photo sensor 11.

In order to measure the surface potential of the intermediate transfer belt 16*c*, a surface electrometer or the like is installed near the primary transfer unit. However, it is difficult to install a surface electrometer near the primary transfer unit 11. Therefore, when it is possible to describe the above relationship based on the potential of the primary transfer bias that is applied to the primary transfer section of the intermediate transfer belt 16*c*, the following becomes possible. It becomes easy to handle the surface potential of the photo sensor 11 and the surface potential of the intermediate transfer belt 16*c*.

There are various kinds of methods of applying the primary transfer bias. When the intermediate transfer belt 16*c* is used as the intermediate transfer unit like in the printer of the present embodiment, for example, the following becomes possible. It becomes possible to apply a bias to a conductive member by disposing it on the internal surface of the intermediate transfer belt 16*c* at the primary transfer section at which the photo sensor 11 is in contact with the intermediate transfer belt 16*c*. For the conductive member, it is possible to use various kinds of members like a roller, a brush or a plate that has been prepared using a conductive material.

When a roller intermediate transfer unit is used, the core of the roller may be prepared using a conductive material, and a voltage may be applied to this core member.

In any instance, the intermediate transfer unit is constructed of a conductive rubber having elasticity and adjusted to a predetermined resistance (in general, $1\times10^3$ to $10^{12}$ Ωcm in volume resistance), or a resin unit adjusted to a predetermined resistance. The surface of the intermediate transfer unit may be coated with a fluorine material in order to increase lubrication of the toner.

In the intermediate transfer unit having a predetermined resistance, there is a high possibility that the potential difference is attenuated before the bias applied to the inner surface reaches the surface of the intermediate transfer unit. This is because the potential difference between the potential at the surface of the photo sensor 11 and the potential at the bias-applied section of the intermediate transfer unit is divided. This division is due to the existence of an air layer and a toner layer, a rubber layer or a resin layer of the intermediate transfer unit between the surface of the photo sensor 11 and the bias-applied conductive portion.

A level of the attenuation of the potential difference is different depending on the material of the structural member. For example, in the printer of the dry-type electronic photographing system according to the present embodiment, the surface potential of the intermediate transfer unit becomes +250 V for the bias application of +700 V, and the potential attenuation of about 500 V occurs. This attenuation of the potential difference largely depends on the structure of the printer and the material selected for the intermediate transfer unit.

When Vt2 represents the potential applied to the primary transfer section of the intermediate transfer unit, and Vt3 represents the attenuation of the potential difference due to a material that constitutes the intermediate transfer unit, the expression 2 and the expression 3 can be expressed as follows.

$$|Vi-Vt2|<Vd+|Vt3| \quad (4)$$

$$|Vb-Vt2|>Vd+|Vt3| \quad (5)$$

Figure 4:
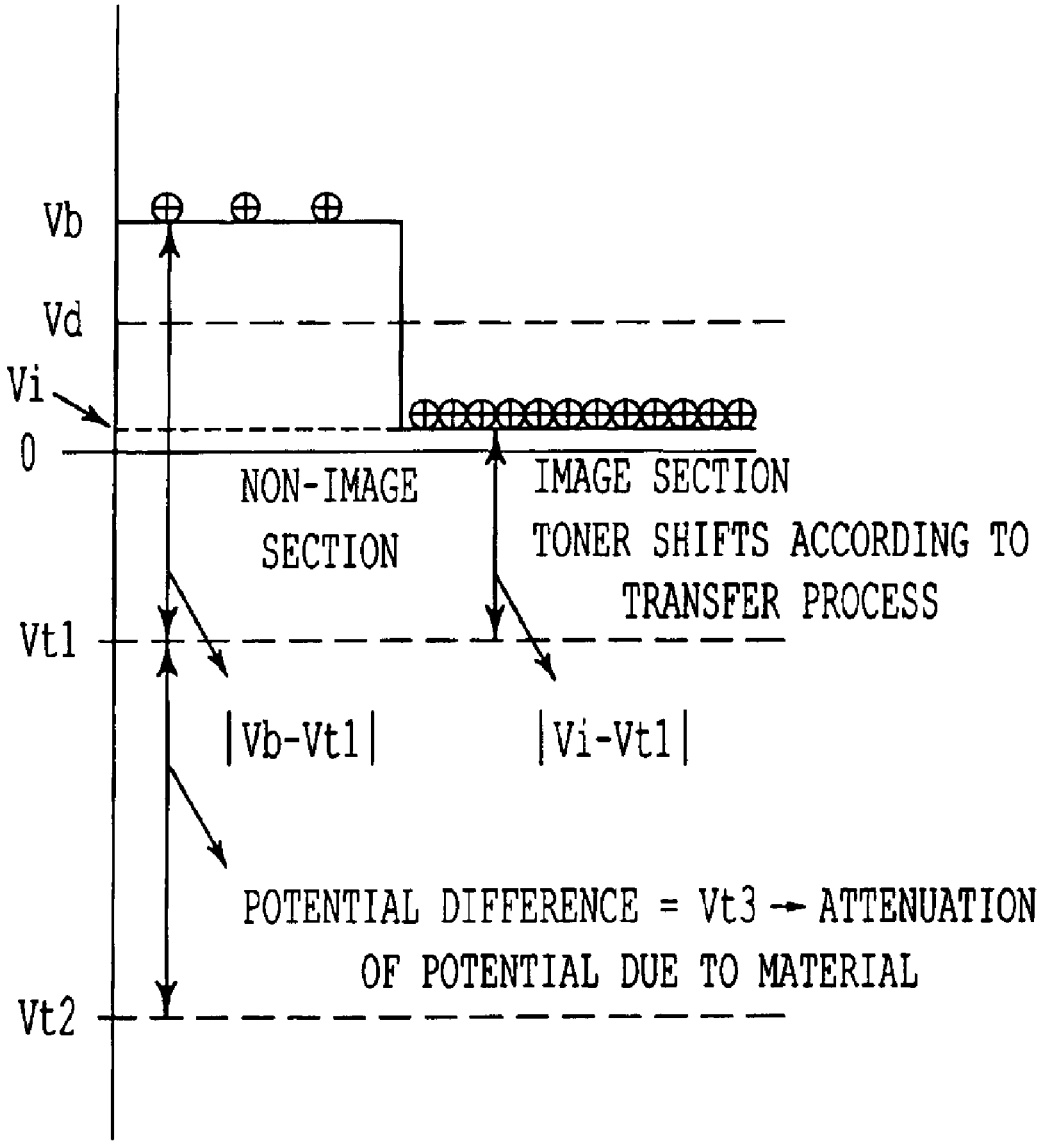
FIG. 4 is a concept diagram which shows a positional relationship when the potential attenuation due to a constitutional material of the intermediate transfer unit is taken into consideration.

Therefore, when the attenuation of the potential difference Vt3 due to a material that constitutes the intermediate transfer unit is measured in advance, it becomes easy to set the potentials of the photo sensor and the intermediate transfer unit from the expression 4 and the expression 5. However, the attenuation of the potential difference Vt3 may be a value that is expressed by the function of the applied voltage Vt2 that changes according to Vt2. Therefore, it is necessary to take care when this attenuation of the potential difference Vt3 is measured (refer to FIG. 4).

Further, as shown in the equation 1, a voltage at which a discharging starts is around 320 V in the environment in which a general image formation apparatus operates. Therefore, when the potential difference Vd at which a discharging is started is estimated as 320 V, it becomes possible to simplify the expression 2, the expression 3, the expression 4, and the expression 5, without determining this potential difference Vd according to the environment of using the printer.

Figure 5:
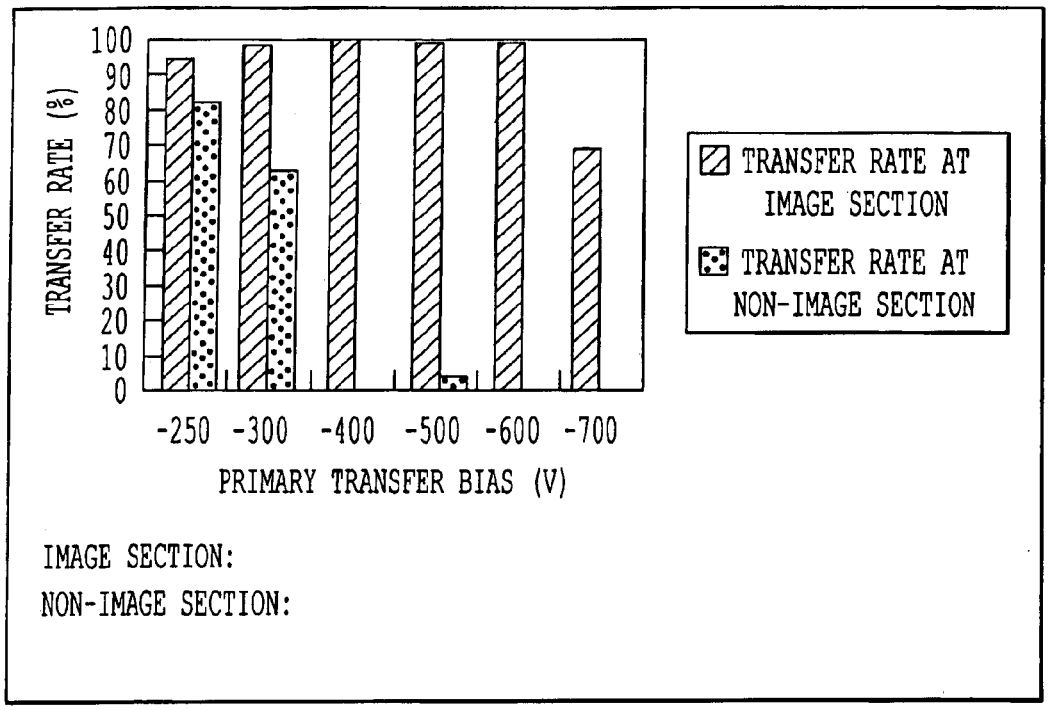
FIG. 5 is a graph which shows a relationship between a primary transfer bias that is applied to the intermediate transfer unit and toner transfer rates of the image section and the non-image section of the photo sensor.

For example, according to the image formation apparatus of the wet-type electronic photographing system to be described later, the toner concentration after the development at the image section of the photo sensor is 1.44, and the toner concentration at the non-image section is 0.17. In this instance, the surface potential of the photo sensor at the primary transfer section is about +50 V at the image section and about +400 V at the non-image section. FIG. 5 shows a result of measuring toner transfer rates of the toner at the image section and the toner slightly adhered to the non-image section, by changing the primary transfer bias.

As shown in FIG. 5, the toner of the non-image section is also transferred to the intermediate transfer unit, when the primary transfer bias is in the range up to −300 V. However, when the primary transfer bias is within the range from −400 V to −700 V, the toner of the non-image section is little transferred. The transfer rate at the image section is substantially close to 100% when the primary transfer bias is within the range from −400 V to −500 V, and there is substantially no influence to the image within this voltage area. However, it is clear that the transfer rate at the image section is degraded when the primary transfer bias is near −700V, and that an abnormal discharging starts between the image section and the intermediate transfer unit surface.

In this experiment, the voltage attenuation |Vt3| due to the material of the intermediate transfer unit is about 400 V. When this condition is substituted into the expression 4 and the expression 5, the following relationships are obtained.

$$|+50-Vt2|<320+400=720 \rightarrow Vt2>-680$$

$$|+400-Vt2|>320+400=720 \rightarrow Vt2>-320$$

Therefore, it can be said that when the applied voltage Vt2 is within the range of −680 V<Vt2<−320 V, it is possible to transfer the toner image on the photo sensor onto the intermediate transfer unit, and it is possible not to transfer the toner of stained texture onto the intermediate transfer unit. This relational expression coincides with the result of the above experiment.

The attenuation of the potential difference Vt3 of the intermediate transfer unit largely depends on the structure of the material that constitutes the intermediate transfer unit, as described above. In other words, when a material having a too large specific resistance is used for the intermediate transfer unit, the absolute value of the attenuation of the potential difference Vt3 becomes too large. When the attenuation of the potential difference |Vt3| has changed to some extent due to a variation in the environment, this influence becomes large. Consequently, the relationships of the expression 4 and the expression 5 cannot be satisfied.

On the other hand, when a material having a too small specific resistance is used for the intermediate transfer unit, the following problem occurs. A charge move quantity a teach time of discharging becomes large, when a discharging occurs between the non-image section of the photo sensor and the surface of the intermediate transfer unit. This results in the occurrence of variations in the discharging. For example, when the toner image of the primary transfer on the intermediate transfer unit is formed with fine dots, the non-image section and the image section are laid out in complex. This has a risk that the discharging affects the image section. Therefore, it is preferable that a material that constitutes the intermediate transfer unit has a volume resistance of around $1\times10^3$ to $10^{10}$ Ωcm.

There are various kinds of photo sensors that are actually used in this type of printer. For example, there is a photo sensor on which attenuation of the latent image potential is fast. There is a photo sensor on which attenuation of the latent image potential is not so fast, but a distance (time) from a charged position to a transfer position is long, like a photo sensor belt. There is also a photo sensor on which a process speed is slow. Therefore, there is an instance where it is not possible to take sufficient potential contrast between the image section and the non-image section of the photo sensor at the primary transfer position. In this instance, for effective work of the present invention, the potential contrast is amplified.

Figure 6A:
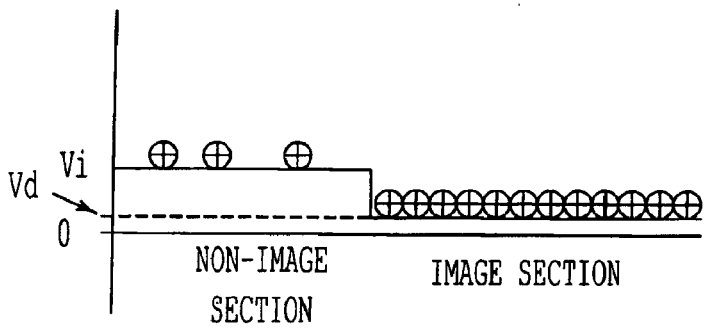
FIG. 6A is a schematic diagram which shows a status that the surface potential of the photo sensor is attenuated after a development, and there is less potential contrast between the image section and the non-image section of the photo sensor.
Figure 6B:
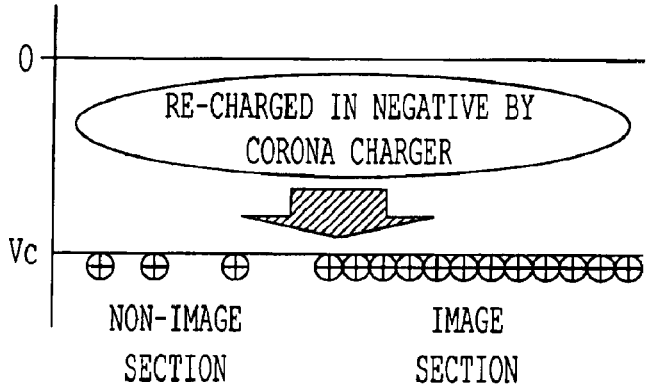
FIG. 6B is a schematic diagram which shows the surface potential of the photo sensor after the photo sensor has been re-charged to the negative side with a corona charger.
Figure 6C:
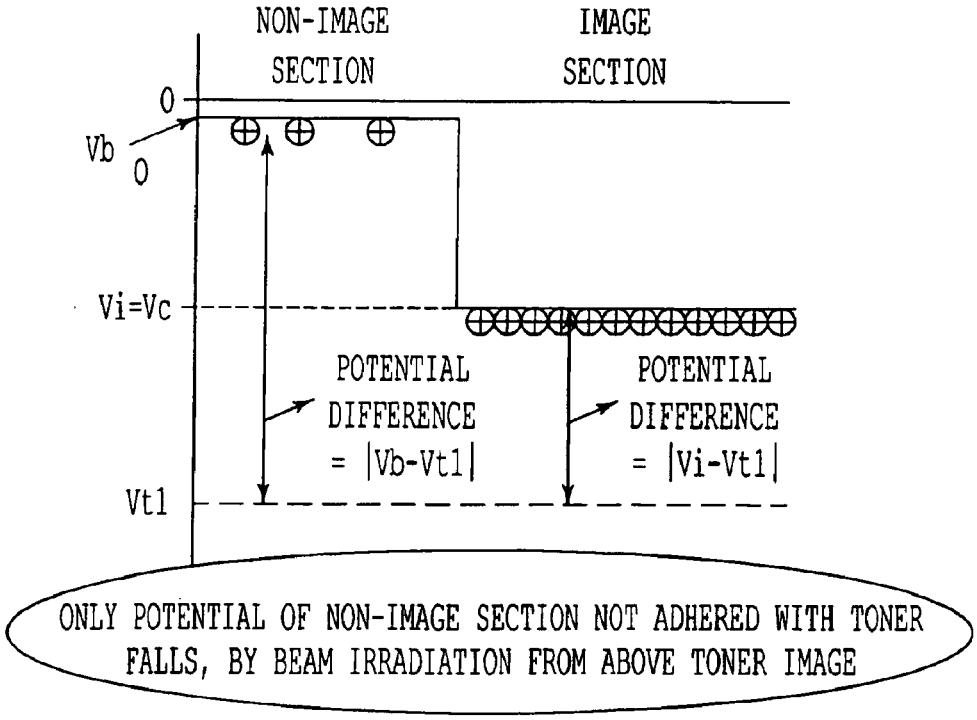
FIG. 6C is a schematic diagram which shows a status that the potential contrast after the exposure of a toner image on the photo sensor has become larger than that in the initial status before the exposure.

FIG. 6A to FIG. 6C shows the principle of the operation of the potential difference amplification process of amplifying the potential contrast.

In this potential difference amplification process, the surface of the photo sensor is first re-charged with a charging unit like colotron or strocoron, thereby to finish the total surface potential. Thereafter, light like LD and halogen light is irradiated onto the surface of the photo sensor from above the toner image formed on the photo sensor. In this instance, the irradiated beam on the image section of the photo sensor adhered with the toner is interrupted by the toner. Therefore, the light does not reach the photosensitive layer of the photo sensor. Consequently, the potential of the image section is not lost. On the other hand, the non-image section of the photo sensor is adhered with a sight quantity of toner. However, as the toner quantity is not sufficient enough to interrupt the irradiation beam, the potential of the non-image section is attenuated. As a result, it is possible to expand the contrast of the potential on the photo sensor again.

When the toner image on the photo sensor is formed with the black toner, beams of most of exposure wavelengths are absorbed. Therefore, there is no problem in this instance. However, when the toner image is formed with a color toner like magenta, for example, the toner can easily pass through beams of long wavelengths, and does not absorb beams of specific wavelengths. Therefore, it is necessary to carefully select wavelengths that are used for the exposure according to the kinds of toners to be used, in the potential difference amplification process. Further, in principle, a charge of a polarity and an opposite polarity of the toner adhered on the photo sensor is performed on the toner image. Consequently, in selecting toners that form a toner image, it is necessary to select toners of which polarity does not easily change even when a charge of an opposite polarity is applied.

While the printer of the dry-type electronic photographing system has been explained in the above embodiment, it is also possible to apply the present invention to the wet-type image formation apparatus that performs an image formation according to the wet-type electronic photographing system.

Figure 7:
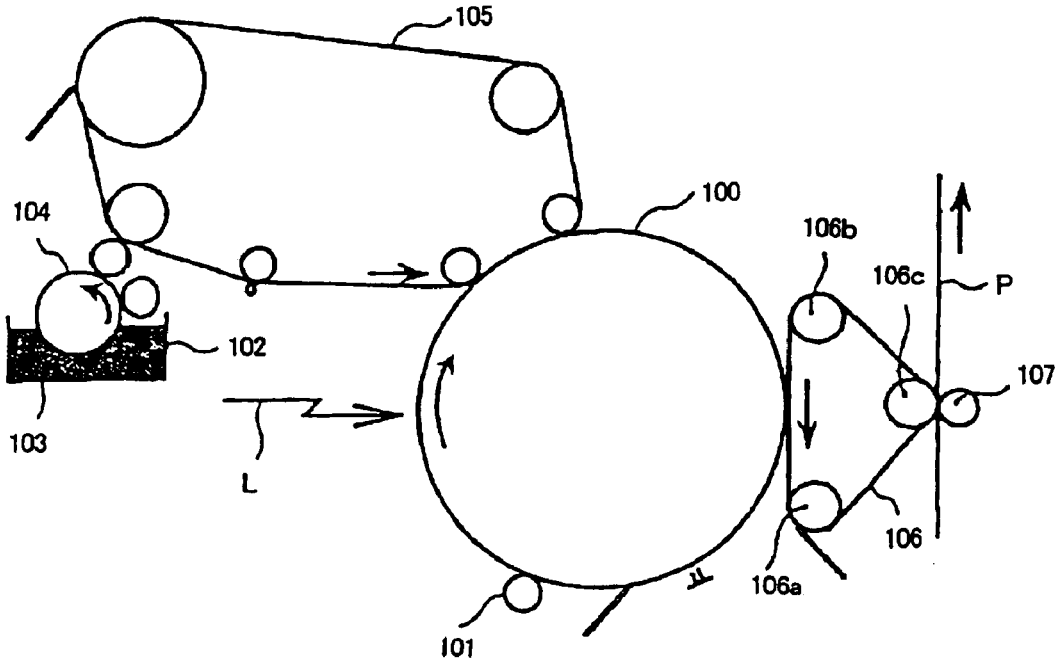
FIG. 7 is a schematic structure diagram of a wet-type image formation apparatus according to another embodiment of the present invention.

FIG. 7 shows one example of an application of the present invention to the wet-type image formation apparatus.

In this wet-type image formation apparatus, when a carrier of high viscosity is used and also when a developing agent of high viscosity and high concentration including toner particles of 10% to 30% in weight is used, there is the following problem. It is difficult to prevent the toner from adhering to the non-image section of the photo sensor, in the developing process. Therefore, when the present invention is applied to this wet-type image formation apparatus, it is possible to obtain a satisfactory image without staining the non-image section with the toner.

In the wet-type image formation apparatus according to the present embodiment, only toner particles having a positive polarity will be used.

Referring to FIG. 7, the surface of a photo sensor drum 100 is uniformly charged in positive polarity by a charging roller 101. Thereafter, an image section of the photo sensor drum 100 is exposed with an exposure beam L from an exposing unit not shown. Consequently, a predetermined electrostatic latent image is formed on the photo sensor drum 100. On the other hand, a liquid developing agent 103 within a developing tank 102 is absorbed into a coating roller 104 dipped in the liquid developing agent 103, and is coated uniformly and thin onto a developing belt 105.

The photo sensor drum 100 and the developing belt 105 are rotated in contact with each other at an equal speed in the directions of arrow marks respectively. Based on this, a thin layer of the liquid developing agent coated on the developing belt 105 is brought into contact with an electrostatic latent image formed on the photo sensor drum 100. At this time, the liquid developing agent on the developing belt 105 shifts to the photo sensor drum 100 side in the area where the potential of the electrostatic latent image on the photo sensor drum 100 is lower than the developing bias. The liquid developing agent on the developing belt 105 does not shift to the photo sensor drum 100 side and remains on the developing belt 105 in the area where the potential of the electrostatic latent image on the photo sensor drum 100 is higher than the developing bias. A toner image is formed on the photo sensor drum 100 in this way. The developing belt 105 may be in a roller shape, and the photo sensor drum 100 may be in a belt shape.

The toner image formed on the photo sensor drum 100 is primary transferred onto an intermediate transfer belt 106 that has been applied with a transfer bias in a polarity opposite to that of the toner. The transfer bias may be applied to the intermediate transfer belt 106 from any one of rollers 106*a*, 106*b*, and 106*c* on which the intermediate transfer belt 106 is rotated. Like in the above printer, the transfer bias may be applied through a roller, brush or plate conductive material on the internal surface of the intermediate transfer belt 106 at the primary transfer side at which the photo sensor drum 100 is in contact with the intermediate transfer belt 106.

In forming a color image, the above toner image formation process is repeated by a plurality of times, thereby to transfer toner images of a plurality of colors in superimposition onto the intermediate transfer belt 106 as the primary transfer.

The toner images of primary transfer on the intermediate transfer belt 106 are collectively transferred, as a secondary transfer, onto paper P that is conveyed in sandwich between the intermediate transfer belt 106 and a secondary transfer roller 107 under pressure. This secondary transfer is carried out according to a secondary transfer bias applied to the secondary transfer roller 107.

According to the wet-type image formation apparatus, there is also an instance where it is not possible to take sufficient potential contrast between the image section and the non-image section of the photo sensor at the primary transfer position, depending on the characteristics of the photo sensor used. In this instance, it is preferable to amplify the potential contrast as described above.

Figure 8:
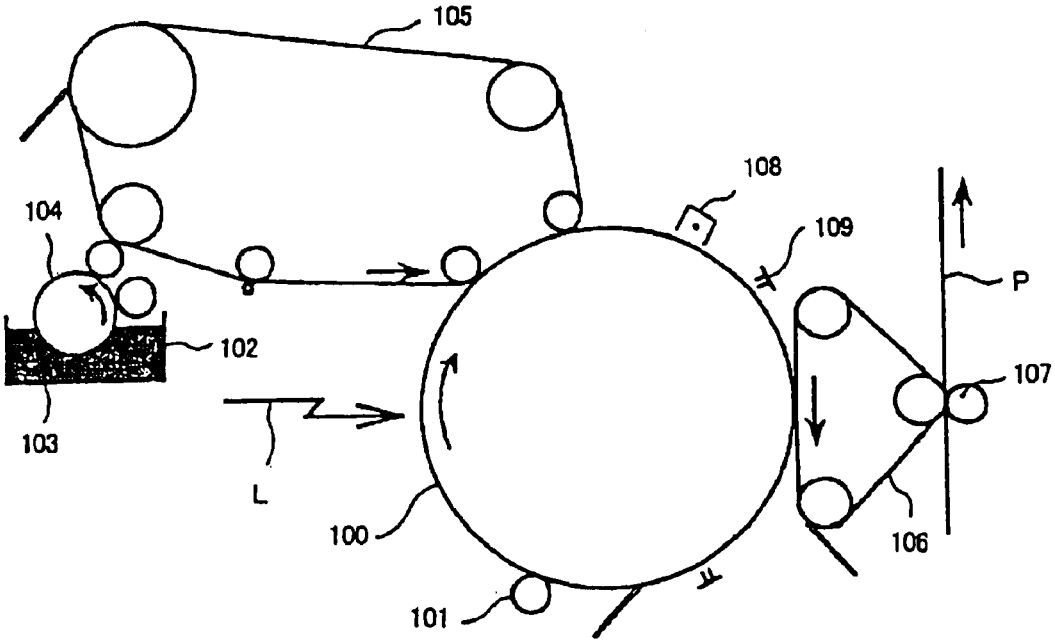
FIG. 8 is a schematic structure diagram which explains a process of amplifying a potential difference between the surface potential of the image section and the surface potential of the non-image section on the photo sensor in the wet-type image formation apparatus.
Figure 9:
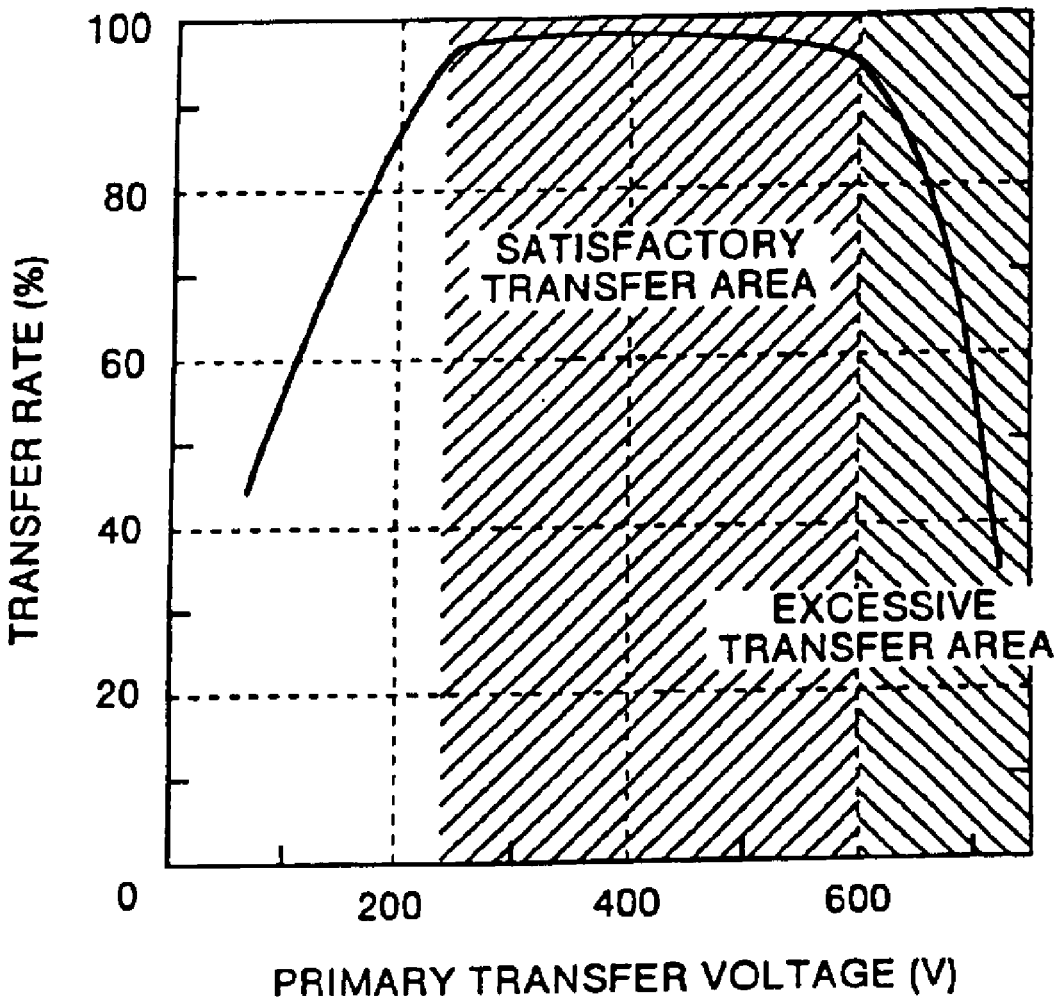
FIG. 9 is a graph which shows a relationship between a primary transfer voltage that is applied to the intermediate transfer unit and a transfer rate of a toner transfer to the intermediate transfer unit in the image formation apparatus according to the present invention.

FIG. 8 shows one example of a wet-type image formation apparatus provided with a re-charging unit 108 and a quenching lamp 109 for re-exposure that are used to amplify the potential contrast. The principle of the operation of the potential difference amplification process of amplifying the potential contrast is similar to that shown in FIG. 6A to FIG. 6C, and therefore, their explanation will be omitted.

As explained above, according to one aspect of the present invention, the surface potentials of the image section and the non-image section of the image holder and the surface potential of the image-receiving unit are set as follows. The toner of the image section is transferred onto the image-receiving unit and the toner of the non-image section is not transferred to the image-receiving unit. Therefore, there is an excellent effect that it is possible to obtain an image without a stained texture.

Further, according to another aspect of the invention, there is an excellent effect that it is possible to utilize a transfer material of high general-purpose application and still obtain a color image of satisfactory image quality with less stain on the texture.

Further, according to still another aspect of the invention, a potential difference is generated such that no discharging occurs at the image section of the image holder and a discharging can occur at the non-image section. The potential of the non-image section is attenuated by the discharging, and the polarity of the stained toner that slightly remains on the image holder at the developing time is inverted by the discharging. Therefore, the transfer of stained toner onto the image-receiving unit is securely avoided. Consequently, there is an excellent effect that it is possible to obtain an image with less stained texture.

Further, according to still another aspect of the invention, there is an excellent effect that it is easy to set optimum potentials at the image formation time, by measuring in advance the attenuation of the potential difference due to a material that constitutes the intermediate transfer unit.

Further, according to still another aspect of the invention, there is an excellent effect that it is possible to set optimum potentials more easily at the image formation time, without determining a potential difference at which a discharging is started according to the environment of using the apparatus.

Further, according to still another aspect of the invention, it is possible to eliminate the inconvenience of variations in potential attenuation and discharging of the intermediate transfer unit, by setting the volume resistance of a material that constitutes the intermediate transfer unit to around $1\times10^3$ to $10^{10}$ Ωcm. Therefore, there is an excellent effect that it is possible to more efficiently avoid the transfer of stained toner of the non-image section, and it is possible to obtain an image without a stained texture.

Further, according to still another aspect of the invention, a potential-difference amplifying unit amplifies a potential difference between the image section and the non-image section of the image holder prior to the transfer of a toner image onto the image-receiving unit. Therefore, there is an excellent effect that it is possible to take sufficient potential contrast between the image section and the non-image section of the image holder, and it is possible to obtain an image without a stained texture.

Further, according to still another aspect of the invention, as the potential-difference amplifying unit, there is used a unit that amplifies a potential difference by irradiating a beam onto a toner image after the surface of the photo sensor has been re-charged. Therefore, it is possible to take sufficient potential contrast between the image section and the non-image section of the image holder, by applying the existing technique. As a result, there is an excellent effect that it is possible to securely obtain an image without a stained texture at low cost.

Further, according to still another aspect of the invention, it is possible to apply the above aspects of the invention to the wet-type image formation apparatus. Therefore, there is an excellent effect that it is possible to obtain an image without a stained texture, by solving the stained toner at the non-image section that particularly becomes the problem in the wet-type image formation apparatus.

The present document incorporates by reference the entire contents of Japanese priority document 2001-13715 filed in Japan on May 8, 2001.

Although the invention has been described with respect to a specific embodiment for a complete and clear disclosure, the appended claims are not to be thus limited but are to be construed as embodying all modifications that may occur to one skilled in the arts which fairly fall within the basic teaching herein set forth.

What is claimed is:

1. An image formation method comprising:

forming an electrostatic latent image on the surface of an image holder;

developing the electrostatic latent image by using a charged toner; and transferring a toner image from the image holder onto an image-receiving unit by applying a transfer bias to the image receiving unit;

wherein an amount of the transfer bias is set such that potential differences between surface potentials of an image section and a non-image section of the image holder and a surface potential of the image-receiving unit generate a discharging at the image section and do not generate a discharging at the non-image section.

2. The image formation method according to claim 1, wherein the image-receiving unit is an intermediate transfer unit that transfers a primary-transfer toner image on the image holder onto a transfer material as a secondary transfer.

3. The image formation method according to claim 1, further comprising:

setting a surface potential Vt1 of the image-receiving unit to satisfy $$|Vi-Vt1|<Vd,\ |Vb-Vt1|>Vd$$

where, Vd represents a potential difference at which a discharging is started between two objects in the environment of forming an image, Vi represents a surface potential of the image section on the image holder, and Vb represents a surface potential of the non-image section on the electrostatic latent image.

4. The image formation method according to claim 2, wherein the following relationships are satisfied $$|Vi-Vt2|<Vd+|Vt3|,\ |Vb-Vt2|>Vd+|Vt3|$$

where, Vd represents a potential difference at which a discharging is started between two objects in the environment of forming an image, Vi represents a surface potential of the image section on the image holder, Vb represents a surface potential of the non-image section on the image holder, Vt2 represents a potential applied to the intermediate transfer unit, and Vt3 represents an attenuation of a potential difference due to the intermediate transfer unit.

5. The image formation method according to claim 3, further comprising:

setting the potential difference Vd, at which a discharging is started between two objects in the environment of forming an image, to 320 V.

6. The image formation method according to claim 2, wherein a material that constitutes the intermediate transfer unit has a volume resistance of $1\times10^3$ to $10^{10}$ Ωcm.

7. The image formation method according to claim 4, wherein a material that constitutes the intermediate transfer unit has a volume resistance of $1\times10^3$ to $10^{10}$ Ωcm.

8. The image formation method according to claim 1, further comprising:

amplifying a potential difference between the image section and the non-image section of the image holder prior to the transfer of the toner image onto the image-receiving unit.

9. The image formation method according to claim 8, wherein the potential difference is amplified by irradiating a beam onto the toner image after the surface of the image holder has been re-charged.

10. The image formation method according to claim 1, wherein the developing is a wet-type developing that develops the electrostatic latent image formed on the image holder by using a liquid developing agent.

* * * * *